United States Patent [19]

Bisschop et al.

[11] 4,396,427

[45] Aug. 2, 1983

[54] METHOD OF AND TILTABLE LADLE FOR THE TREATMENT OF CAST IRON MELT

[75] Inventors: Hubertus A. J. M. Bisschop; Hendrikus Meijers, both of Belfeld; Jozef J. M. van der Randen, Venlo, all of Netherlands

[73] Assignees: Metallgesellschaft Aktiengesellschaft, Frankfurt am Main; SKW Trostberg AG, Trostberg, both of Fed. Rep. of Germany

[21] Appl. No.: 347,050

[22] Filed: Feb. 8, 1982

[30] Foreign Application Priority Data

Feb. 13, 1981 [DE] Fed. Rep. of Germany ..... 3105200

[51] Int. Cl.[3] ..... C22C 33/08

[52] U.S. Cl. ..... 75/130 R

[58] Field of Search ..... 75/130 R

[56] References Cited

U.S. PATENT DOCUMENTS 3,955,974 5/1976 Alt ..... 75/130 R

*Primary Examiner*—P. D. Rosenberg

*Attorney, Agent, or Firm*—Karl F. Ross; Herbert Dubno

[57] ABSTRACT

A method of and a ladle for the treatment of a cast iron melt with a substance capable of inducing the formation of spheroidal graphite utilizes an elongated generally cylindrical vessel lined with a refractory and formed at opposite ends with cylinder bottoms. The vessel can be tilted between a horizontal and upright orientation and angularly displaced about a longitudinal axis at least in its horizontal orientation. A partition in the vessel adjacent one of the cylinder bottoms defines a chamber at one end of the vessel opening within the vessel toward the opposite end thereof and disposed at an upper portion of the vessel in its horizontal orientation. A closable opening at the other end of the vessel enables a cast iron charge to be introduced into the vessel in the horizontal orientation thereof. The vessel is then tilted upwardly to effect the reaction and swung back to its horizontal orientation for deslagging before the charge is tapped by angular displacement about the longitudinal axis.

14 Claims, 4 Drawing Figures

METHOD OF AND TILTABLE LADLE FOR THE TREATMENT OF CAST IRON MELT

FIELD OF THE INVENTION

The present invention relates to a method of and a tiltable ladle for the treatment of a cast iron melt and, more particularly, to a treatment ladle in which a cast iron is treated with a material capable of inducing the formation of spheroidal graphite in, for example, the production of nodular or spherolytic cast iron.

BACKGROUND OF THE INVENTION

In the production of spherolytic or nodular cast iron, i.e. cast iron containing spheroidal or globular graphite, the cast iron melt may be treated with substances, known in the art, for inducing the formation of spheroidal graphite. Such treatment can be carried out in a ladle between the blast furnace or other furnace in which the cast iron melt is formed and the location at which the melt is to be cast into molds.

Tiltable ladles have been provided for this purpose in the past (see, for example, German patent application DE-AS No. 22 16 796) in which the ladle is formed like a tiltable converter so as to swing about a transverse axis, i.e. an axis perpendicular to the longitudinal axis of the elongated ladle which may have a charging and tapping opening at one end, i.e. the top, when the ladle is in an erect state.

At the opposite end or bottom, the ladle is provided with a chamber into which the substance capable of inducing formation of spheroidal graphite is introduced.

This chamber can be charged with the inducing substance from the exterior and communicates with the melt-receiving compartment of the ladle via openings in the wall therebetween.

These openings permit penetration of the melt into the chamber and passage of vapors of the inducing substance upwardly into the melt when the ladle is in an erect position.

The mouth of the converter, into which the molten iron is charged and from which the molten iron is discharged or tapped, can be closed with a cover.

In the horizontal position of the converter, the melt is charged into the latter in such manner that it does not come into contact with the contents of the aforementioned chamber. When the ladle is swung into its erect position, however, molten metal passes through the opening into the chamber and vapors of the substance capable of inducing spheroidal graphite formation pass upwardly to treat the melt.

The charging of such vessels with the melt and the inducing substance is time-consuming and labor intensive, and the maintenance and labor operations are extensive. In addition, since the converter cannot be used effectively as a transport or casting vessel, the treated melt must be transferred to a transport ladle and cast from the latter into the molds.

Another treating unit is described in German Open Application DE-OS No. 25 14 490 and has the configuration of a cylindrical vessel rotatable about the axis of the cylinder, i.e. a horizontal axis.

This ladle has a filling and tapping opening and is partitioned internally by a grate into a melt-receiving chamber and a chamber which can be charged from the exterior with the substance capable of inducing the formation of spheroidal graphite.

Even this ladle has not been found to be effective in all cases.

For example, for some casting purposes it is necessary to provide an intermediate receptacle or ladle below the treatment drum. The technological defects of this system include high maintenance and replacement costs for the grate enclosures.

OBJECTS OF THE INVENTION

It is the principal object of the present invention to provide a treatment ladle which avoids the disadvantages of of the earlier systems described.

Another object of this invention is to provide a ladle for the treatment of a cast iron melt with a substance capable of inducing the formation of spheroidal graphite therein, e.g. in the production of nodular cast iron, which requires less maintenance and is of reduced capital and operating costs.

Still another object of this invention is to provide a more efficient treating ladle for the purposes described.

Yet another object of this invention is to provide an improved method of treating cast iron melt so as to induce the formation of spheroidal graphite therein.

SUMMARY OF THE INVENTION

These objects and others which will become apparent hereinafter are attained in accordance with the invention, utilizing a refractory-lined cylindrical, steel-shelled ladle which is tiltable about a transverse axis and can be angularly displaced about a longitudinal axis, the vessel being formed proximal to its base with a partition defining a chamber for the ladle in the direction of the opposite end.

The opposite end is provided with an opening which can be closed by a cover for charging and discharging the ladle.

The partition of the present invention extends along a chord of a cross-section through the ladle to the bottom thereof and defined with this bottom, and the cylindrical wall of the ladle are joined by the partition, the aforementioned compartment opening paralel to the longitudinal axis and constituting a cylindrical segment. The chamber thus can be supplied with the inducing substance through a removable cover laterally or by feeding the substance through the aforementioned charging opening into the chamber whereby it is held, in a horizontal position of the ladle, well above the lowest portion of the melt-receiving chamber.

The melt can then be charged into the ladle, to a height, in the horizontal position of the ladle, below the edge of the partition defining the mouth of the chamber, whereupon the ladle is swung into its upright position about the transverse axis to allow the melt to pass over this edge and into the chamber which, now being upwardly open, permits the substance to be intimately and homogeneously distributed in the melt.

The ladle can then be tilted around its transverse axis into a horizontal position in which angular displacement about the longitudinal axis is possible for discharging the melt. The melt can also be tapped through a pouring spout or syphon formed laterally of the melt chamber by such angular displacement of the ladle about the longitudinal axis.

The ladle can be formed from a cylindrical drum having a steel-shell lined with refractory, and closed at its ends by a pair of bottoms which can also be refractory lined. The connection of one or both bottoms with the cylindrical shell can be effected by flanges joined by bolts or rivets.

The longitudinal axis about which angular displacement of the ladle can be effected as described can be central, i.e. can correspond to the axis of the cylinder, but preferably is offset from the axis of the cylinder and is advantageously disposed externally of the cylinder.

Preferably the transverse axis is disposed substantially midway along the length of the drum and substantially in the horizontal median plane therethrough. While the preferred orientation of the transverse axis is radial, it can also lie along a secant to the cross section of the drum.

To permit angular displacement of the drum about the longitudinal and transverse axes, the drum can be formed with pivot pins which can be affixed to the bottoms or to the cylindrical shell.

It has already been noted that in the preferred mode, the longitudinal axis is disposed outside the shell. In this case, the bottoms can be formed with lugs carrying the pivot pins defining the longitudinal axis, or with bearing blocks which can swingably receive pivot pins from which the ladle can be supported.

The pivot pins, which may extend axially away from one another, enable the ladle to be engaged by a frame suspended from a crane or by hooks of a traveling crane to enable the displacement of the entire ladle within the metallurgical plant, e.g. from the location in which it is charged with the cast iron melt, to a location in which it is tapped to pour the mold. The drive for angularly displacing the ladle about its longitudinal axis can likewise be suspended from a crane.

The latter drive can include a chain secured to the shell, preferably at the center thereof, and which can be tractively actuated. The tilting of the ladle into its upright position can also be performed by the crane, e.g. by raising the end formed with the charging opening and lowering the end formed with the discharge opening.

It is possible to form the charging opening as the sole opening, whereby the inducing substance and the metal are introduced through this opening. Where this opening also serves as a discharge opening from which the treated melt is tapped, it is also advantageous to provide it with a casting syphon enabling the discharge of the metal simply and conveniently while retaining any slag within the ladle.

The cast iron can then be poured directly into the mold and the syphon also serves to equalize the pressure between the ambient and the interior when, for example, internal pressure could be generated during the treatment as is the case when the inducing substance is magnesium or a magnesium carrier. The cover can be held closed by bolt or swinging latches or other conventional closures.

The cylinder bottom at the charging and discharging end of the drum can be formed with a slag weir over which the slag can be discharged by slight tilting of the ladle about a transverse axis and with removal or partial opening of the cover.

The partition at the opposite end of the ladle is advantageously located eccentrically (i.e. out of the horizontal median plane) in the horizontal position of the ladle and can be composed of a refractory material, which is the same as that of the lining. This planar or curved plate can advantageously be inclined downwardly and rearwardly to define an angle with the bottom of substantially 45° to 90°, preferably 60° to 85°.

This slight inclination prevents the substance from sliding out of the chamber during tilting of the ladle into a horizontal position from a vertical position in which the inducing substance was introduced into the chamber.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
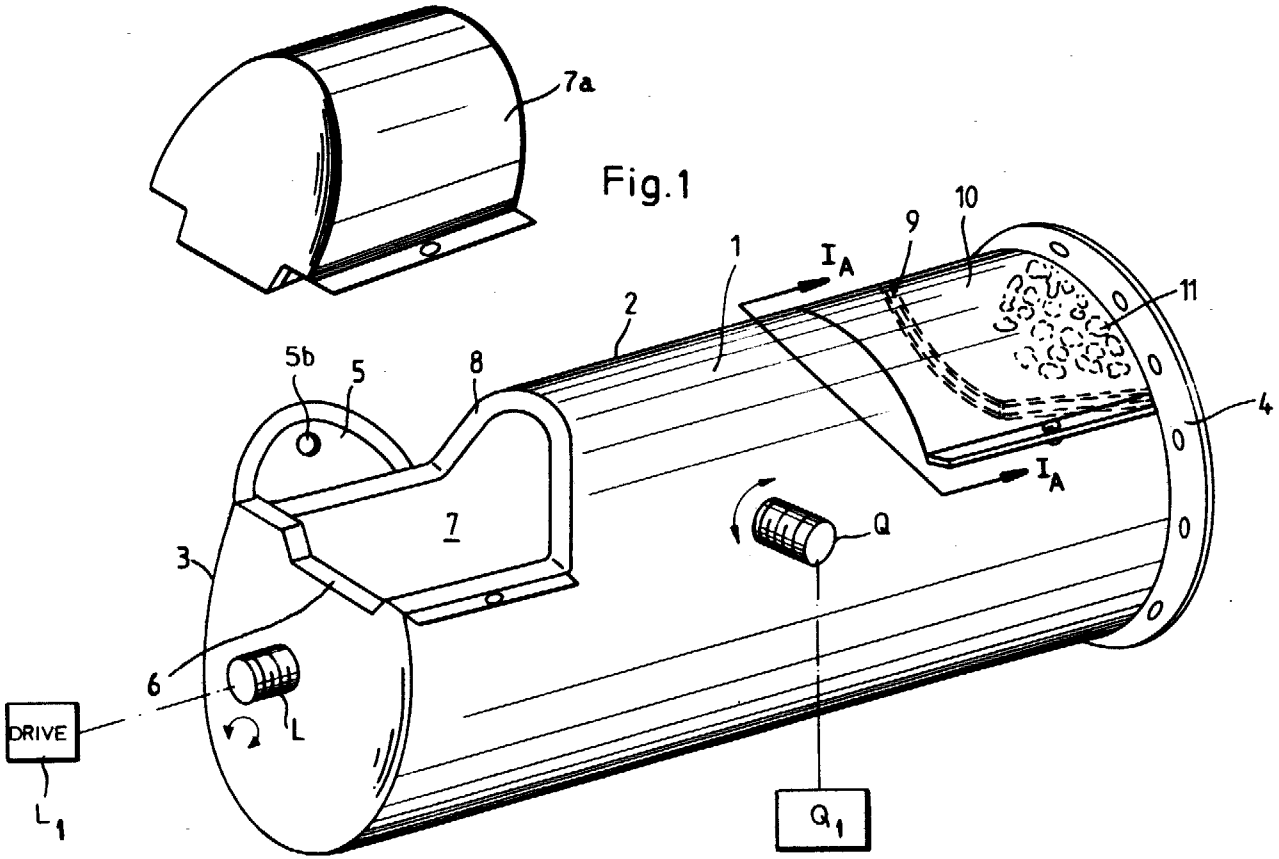
FIG. 1 is a diagrammatic perspective view of a ladle according to the invention.

The apparatus shown in the drawing is intended to treat a cast iron metal with a substance such as magnesium or a magnesium carrier for inducing the formation of spheroidal graphite, thereby producing nodular cast iron.

Figure 1A:
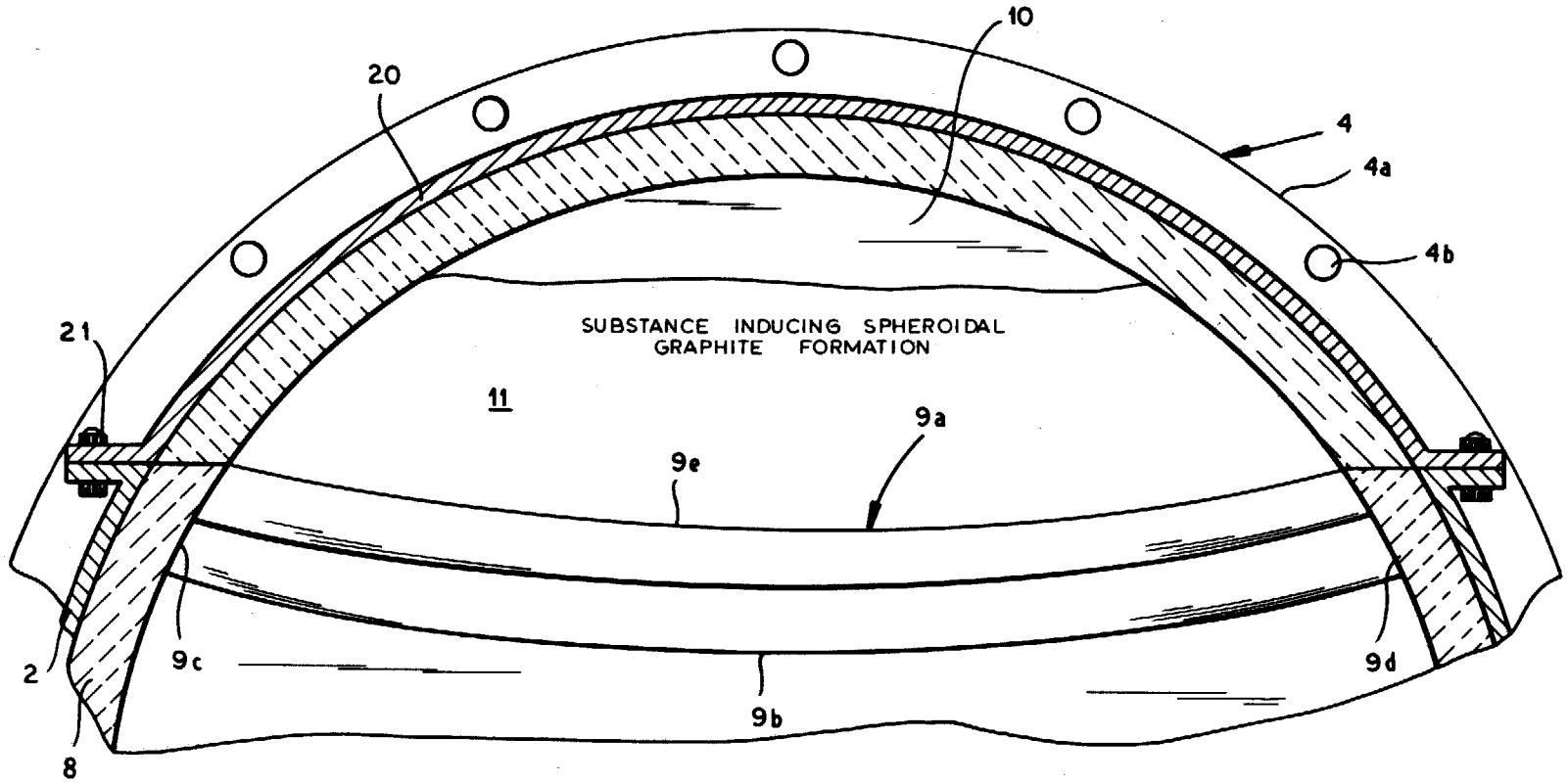
FIG. 1A is a cross sectional view taken along the line IA—IA of FIG. 1.
Figure 2:
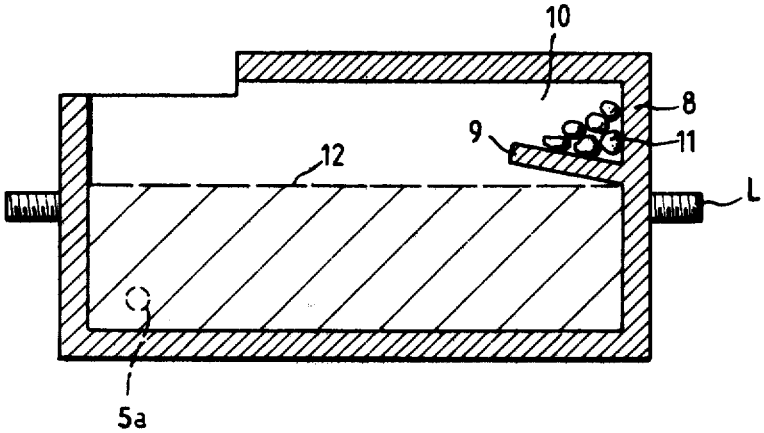
FIG. 2 is an axial cross sectional view thereof.

As is apparent from FIGS. 1, 1A and 2, a cylindrical drum forms the ladle and is composed of a steel shell 2 lined with a refractory layer, the drum being closed at its end by a pair of bottoms 3 and 4.

While the attachment of the bottoms 3 to the shell 2 is shown only diagrammatically, it can be a flange connection, as has been indicated by the flange **4*a*, which with rivets 4*b* secures the bottom to the shell 2**.

Bottom 4 has a larger diameter so as to improve the purchase of the ladle upon the ground when the ladle is erected as will be described in greater detail hereinafter.

In the embodiment 1, 1A and 2, the ladle 1 is pivotally mounted for swinging movement around a longitudinal axis or axially extending pin L located at the center of the cylinder, and transverse pin Q extending radially at the midpoint.

For this purpose, respective drives $L_1$ and $Q_1$ can be coupled with these pins and have not been illustrated further since practically any drive system can be used. For example, the pivot pin L can be journaled on a cradle which can be pivoted about the axis of pins Q, e.g. when the ladle is engaged by crane hooks at these pins.

Systems for driving and mounting a vessel so that it can be angularly displaced about two mutually perpendicular axes are well known and need no detailing here. For example, the pins L can carry a gear which meshes with a pinion or worm driven by an electric motor and a stepdown transmission. Of course, a gear sector can be mounted on the shell or the latter can be provided with a semicircular portion of a ring gear, preferably along the midsection of the shell. These gears can engage a pinion or worm when the ladle is lowered or can permanently engage a pinion or worm carried by the aforementioned cradle.

Similarly, the pin Q can carry appropriately dimensioned gears.

A particularly advantageous arrangement provides a segment of a gear ring in which the pins Q are journaled and by which the ladle can be angularly displaced about the axis Q while the drive carried by this gear swings the ladle into its tilting movement about the pins Q.

The ladle is cut away at 7 to form a charging opening which can be closed by a cover 7*a* and bolts through flanges or a pivotal latch-type closure. A casting syphon 5 is affixed adjacent to this opening and communicates with the melt chamber via a bore 5*a*, having an outlet 5*b* from which the melt can be discharged into the mold.

A deslagging weir 6 is formed by cutting away a portion of the bottom 3.

At the opposite end of the ladle a partition, shown to be curved in FIG. 1A at 9*a* and planar in FIG. 2 at 9, runs to the bottom 4 which it adjoins at an edge 9*b* and to the cylindrical wall, which it adjoins at 9*c* and 9*d* to define a chamber 10 open toward the opposite end at an edge 9*e*. This chamber can be filled with the treating substance 11.

The magnesium or magnesium carrier, e.g. a magnesium alloy, can be introduced into the chamber as described and access to the partition plate can be effected by removal of a cover 20 affixed by closure elements 1 to the shell. In the preferred mode of the invention the ladle is tilted into an upward position and can rest upon the bottom 4 whereupon the cover 7*a* is removed and a tube funnel or hopper discharged downwardly to fill the chamber 10 directly through the opening 7. Funnel-type feeders are provided for this purpose to ensure that the substance will only enter the chamber 10.

In many cases it is advantageous to cover the inducing substance with iron scrap or with other materials which reduce the reaction speed. These materials can include cast iron splinters, borings or other machining detritus, graphite, finely divided coke, calcium carbide, quartz sand or alumina-containing minerals.

The ladel is then tilted into its horizontal position (FIGS. 1 and 2) in which the chamber occupies the upper third (approximately) of the prone cylinder while the melt occupies the lower two-thirds after being introduced through the opening 7.

Of course it is possible to introduce the treating substance into the chamber 10 in the horizontal position by an injection lance and entraining the substance pneumatically. In this case, the erecting step can be avoided.

The surface of the melt is held by the partition 9 or 9*a* out of direct contact with the treating substance.

The cover is closed and the ladle erected rapidly within about 2–5 seconds into its upright position to bring about contact between the magnesium carrier and the melt. The reaction is surprisingly homogeneous and terminates in at most several minutes.

With the ladle again in the horizontal position, the cover can be removed and the ladle slightly rotated about its longitudinal axis L to discharge the slag over the weir 6 and returned to its original prone position. If seeding is required to promote the formation of spheroidal graphite, this can now be done through the opening 7 whereupon by tilting the ladle about its longitudinal axis, the nodular cast iron can be poured directly into the mold.

Figure 3:
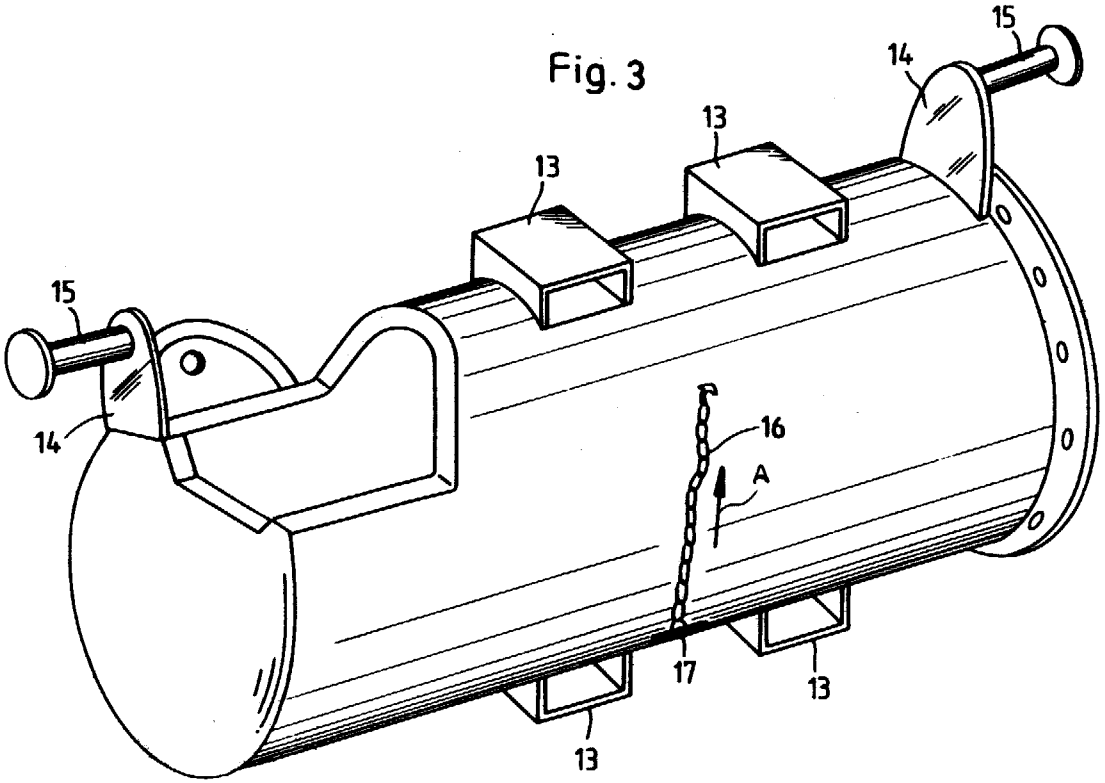
FIG. 3 is a view similar to FIG. 1 illustrating another embodiment of the invention.

FIG. 3 shows an embodiment of the invention which is especially effective when small volumes of cast iron are to be treated.

In this case, hollow profiles 13, e.g. tubes, channels or the like, are welded onto the ladle shell which, except for the differences discussed below, can be identical to the ladle described in connection with FIGS. 1 and 1A. The hollow profiles 13 enable the arms of a tilting mechanism to be inserted and to swing the ladle from its horizontal position shown into a vertical position, e.g. about an axis corresponding to that of pin Q or some other axis parallel thereto. Generally two such profiles on one side of a ladle (opposite opening 7) will suffice, although it is sometimes advantageous to have four profiles as shown in two pairs on opposite sides for greater security.

In this embodiment the longitudinal axis about which the ladle is pivotable, is outside the projection of the shell and is, therefore, offset from the cylinder axis.

To this end, lugs 14 can be mounted on the bottoms of the ladle and can project substantially radially therefrom. These lugs can be affixed to the pivot pins 15 or can form bearing eyes receiving these pins. The pins 15 can rest in a crane-suspended frame and swinging movement of the ladle about the axis defined by the pins 15 can be effected by a chain 16 engaging in an eye 17 affixed centrally to the ladle. Tractive forces applied in the direction of the arrow A can be used to swing the ladle.

The treatment of a cast iron utilizing this ladle is identical to the treatment described with the ladle of FIGS. 1, 1A and 2.

The mode of operation of the apparatus is likewise unique and hence the invention also involves a method of treating a cast iron melt with a substance inducing the formation of spheroidal graphite, this method comprising the steps of:

introducing through a charging opening at one end of an elongated ladle, a quantity of a substance capable of inducing spheroidal graphite formation in a cast iron melt into a chamber defined at the upper end of said ladle by a partition above a melt-receiving space when the ladle is in a horizontal position;

introducing cast iron melt into the ladle in the horizontal position thereof through the opening whereby the melt is separated by the partition from the inducing substance;

tilting the ladle about a horizontal axis into an erect position whereby the melt reacts with the substance in the chamber;

in a substantially horizontal orientation tilting the ladle about a longitudinal axis to discharge the slag from the melt; and discharging the melt from the ladle by angularly displacing same about an axis substantially perpendicular to the longitudinal axis about which the ladle was tilted for deslagging in the substantially horizontal orientation of the ladle.

The preferred substances for inducing spheroidal graphite formation in the cast iron melt are pure magnesium or magnesium alloyed with metal or ferro-silicon and containing between 1 and 50% by weight magnesium.

Magnesium-containing pressed bodies, such as briquettes, sintered bodies containing magnesium and porous bodies impregnated with magnesium and magnesium alloys additionally containing rare-earth metal, such as cerium or cerium-mischmetal, may also be used. It has also been found to be advantageous to add, with the magnesium-containing substance, a rare earth of the type described.

An important advantage of the ladle of the present invention is that it eliminates the slag removal problems which have been encountered with earlier systems and it obviates the need for cleaning treatments of the vessel, e.g. with fluxing agents. The cast iron treatment time is reduced and the output of the unit increased.

In addition, a preheating of the vessel is not required and additional ladles for transport and casting are not required between the smelting furnace and the treatment vessel and between the treatment vessel and the molds. The reaction can be carried out at locations other than at the charging location because of the portability of the ladle of this invention.

Secondly, the ladle of the present invention is analogous to a single-ladle system for the treatment, seeding, transport and casting of the iron melt; affords higher magnesium utilization than has hitherto been the case; and provides a practically smoke and flash free reaction with low temperature losses and no spattering of the melt from the ladle. Losses as a result of iron residues in the ladle are likewise eliminated.

SPECIFIC EXAMPLES

In the following examples a treatment of a cast iron melt is carried out with a magnesium carrier to form nodular cast iron with spheroidal graphite, utilizing the vessel described in connection with the FIG. 3, lined with a neutral refractory.

EXAMPLE 1

In the vertical position of the vessel, a magnesium alloy with a particle size of 1-3 mm and an amount of 1.5% by weight of the cast iron to be treated is introduced into the compartment 10 via a funnel through the opening 7 in the vessel.

The alloy consists by weight of 5.3% magnesium, 2.0% calcium, 45.0% silicon, 0.85% rare-earth metal (cerium mischmetal) and the balance iron.

The vessel is then swung into a horizontal orientation and 1500 kg of a cast iron melt at a temperature of 1460° C. is introduced through the opening 7 which is then closed with the cover.

The iron melt has the following composition by weight: 3.76% carbon, 1.87% silicon, 0.12% manganese, 0.035% phosphorus, 0.010% sulphur and the balance iron.

Over a period of about 3 seconds, the vessel was rotated into its vertical position and the reaction was effected uniformly, calmly and without spattering, practically smoke and flash free. The reaction was completed in 65 seconds and the vessel rotated again into its original position. With slight tilting of the vessel, after removal of the cover, the slag layer on the mouth was poured off and, for seeding, 0.2% by weight ferro-silicon (FeSi 75) was added through the opening 7 in the horizontal orientation. The cast iron melt, at a temperature of 1405° C. was discharged into molds through the syphon by rotation of the vessel about the longitudinal axis.

The products had a nodular cast iron composition about a magnesium content of 0.070% by weight, corresponding to a magnesium utilization of 88%. 90% of the graphite was found to be in the form of globular graphite with the number of globules being 250 per $mm^2$. The structure was cementite free and consisted of 90% ferrite and 10% perlite.

Utilizing a conventional converter-type ladle but otherwise identical parameters, the magnesium utilization was found to be less than 60% in comparative tests and generally less than 50%.

EXAMPLE 2

With the vessel in its horizontal position, utilizing a pneumatic injection lance, a magnesium alloy with a particle size of 1-5 mm was introduced into the chamber 10. The magnesium alloy was introduced in the amount of 1% by weight of the cast iron melt to be treated and had the following composition by weight: 9.8% magnesium, 2.8% calcium, 46.1% silicon, 0.87% rare-earth metal (cerium) and the balance iron.

With the vessel still in its horizontal position 750 kg of a cast iron melt at a temperature of 1455° C. was introduced through the opening 7. The cast iron melt had the following composition by weight: 3.8% carbon, 1.92% silicon, 0.011% manganese, 0.038% phosphorus, 0.009% sulphur and the balance iron.

With the cover applied, the vessel was rapidly raised over a period of 3 seconds to effect a reaction which was complete in 55 seconds. The reaction was effected calmly and without spattering.

The vessel was then swung into its horizontal position and seeded and deslagged in the manner described in Example 1 utilizing 0.1% by weight of FeSi 75.

The melt temperature at the mold casting was 1395° C. In the cast bodies the magnesium content was found to be 0.068% by weight corresponding to a magnesium utilization of 70%. Spheroidal graphite formation amounted to 90% and the count of graphite globules was found to be 300 per $mm^2$. The cementite-free structure consisted of 88% ferrite and 12% perlite.

In comparative tests utilizing conventional converter and open ladles under otherwise similar conditions, the maximum magnesium utilization was about 45%.

We claim:

1. A ladle for the treatment of an iron melt with a substance capable of inducing the formation of spheroidal graphite, comprising:

an elongated generally cylindrical vessel lined with a refractory and formed at opposite ends with cylinder bottoms;

means enabling tilting displacement of said vessel between horizontal and upright orientations;

means for angularly displacing said vessel about a longitudinal axis at least in said horizontal orientation;

a partition in said vessel adjacent one of said cylinder bottoms defining a chamber at one end of said vessel opening within said vessel toward the opposite end thereof and disposed at an upper portion of said vessel in said horizontal orientation thereof, said partition being disposed such that a mouth of said chamber is open toward said opposite end;

a closable opening at said other end of said vessel whereby an iron charge can be introduced into said vessel in said horizontal orientation thereof and is maintained out of contact with a quantity of said substance introduced into said chamber through said mouth and said opening until said vessel is tilted into said upright orientation; and means defining a syphon disposed at said opposite end for discharging treated cast iron upon angular displacement of said vessel about said longitudinal axis.

2. The ladle defined in claim 1 wherein said opposite end of said vessel is formed at said opening with a weir above said syphon and over which slag is discharged by tilting said vessel about an axis transverse to said longitudinal axis.

3. The ladle defined in claim 2 wherein said partition is a planar plate.

4. The ladle defined in claim 2 wherein said partition is a curved plate.

5. The ladle defined in claim 2 wherein said partition includes an angle with said one of said bottoms of substantially 45° to 90°.

6. The ladle defined in claim 5 wherein said angle is 60° to 85°.

7. The ladle defined in claim 2 wherein said longitudinal axis is located along and coincides with the central axis of said vessel.

8. The ladle defined in claim 2 wherein said longitudinal axis is offset from said central axis.

9. The ladle defined in claim 2 wherein said vessel is provided with means defining a transverse axis extending generally radially and about which said vessel can be rotated between said orientations.

10. The ladle defined in claim 9 wherein said orientation is generally radial.

11. The ladle defined in claim 2 wherein said chamber is located directly below said opening in said upright orientation of said vessel.

12. A method of treating an iron melt with a substance capable of inducing spheroidal graphite formation in cast iron, said method comprising steps of:

introducing a quantity of said substance into a chamber formed at one end of an elongated cylindrical refractory-lined vessel by swinging said vessel into an upright position about a transverse axis with an opening at the other end of said vessel receiving said substance which is passed downwardly into said chamber which is located at the bottom of the upright vessel;

introducing into said vessel in a horizontal orientation thereof through said opening at the other end a cast iron melt while maintaining said substance out of contact with said melt with a partition defining said chamber and oriented such that said chamber opens toward said opening;

swinging said vessel into upright orientation about said transverse axis to permit said melt to react with said substance;

swinging said vessel into a substantially horizontal orientation about said transverse axis and pouring slag from the melt therein through said opening; and discharging said melt from said vessel by angularly displacing said vessel about a longitudinal axis perpendicular to said transverse axis.

13. The method defined in claim 12 wherein said substance is introduced into said chamber in said horizontal orientation of said vessel via a lance introduced into said vessel through said opening.

14. An apparatus for the treatment of an iron melt with a substance capable of inducing the formation of spheroidal graphite comprising:

an elongated cylindrical vessel lined with a refractory and formed at opposite ends with cylinder bottoms;

means enabling the displacement of said vessel within an iron making plant;

a flange structure mounting at least one of said cylinder bottoms on said vessel;

means enabling tilting displacement of said vessel between horizontal and upright orientations about a generally transverse axis;

means for angularly displacing said vessel about a longitudinal axis substantially perpendicular to said horizontal axis at least in said horizontal orientation of said vessel;

means forming a charging opening at one end of said vessel;

a partition in said vessel adjacent a respective cylinder bottom provided with said flange structure at the other end of said vessel remote from said opening and defining a chamber at said other end opening within said vessel toward said opening and disposed at an upper portion of said vessel in said horizontal orientation thereof, said partition defining a mouth of said chamber turned toward said opening to receive said substance through said opening and said mouth when said vessel is in its upright orientation, said partition maintaining said substance out of contact with a melt of iron introduced to said opening in a horizontal orientation of said vessel;

a syphon disposed at said one end of said vessel for discharging treated cast iron upon angular displacement of said vessel about said longitudinal axis; and a weir formed at said one end of said vessel and partly defining said opening above said syphon for enabling slag to be discharged from said vessel over said weir by tilting of said vessel about the transverse axis.

* * * * *